US006046153A

United States Patent [19]

Chapman et al.

[11] Patent Number: 6,046,153

[45] Date of Patent: Apr. 4, 2000

[54] SPRAY DRYING PROCESS FOR PRODUCING DETERGENT COMPOSITIONS INVOLVING PREMIXING MODIFIED POLYAMINE POLYMERS

[75] Inventors: Benjamin Edgar Chapman, Cincinnati, Ohio; James Robert Lickiss, Newcastle upon Tyne, United Kingdom; Randall Alan Watson, Cincinnati, Ohio

[73] Assignee: The Procter & Gamble Company, Cincinnati, Ohio

[21] Appl. No.: 09/242,996

[22] PCT Filed: Aug. 6, 1997

[86] PCT No.: PCT/US97/13650

§ 371 Date: Jul. 9, 1999

§ 102(e) Date: Jul. 9, 1999

[87] PCT Pub. No.: WO98/08928

PCT Pub. Date: Mar. 5, 1998

Related U.S. Application Data

[60] Provisional application No. 60/026,900, Aug. 26, 1996.

[51] Int. Cl.[7] ..... C11D 11/00

[52] U.S. Cl. ..... 510/443; 510/452; 510/299; 510/475; 510/499; 510/503; 510/504; 510/528

[58] Field of Search ..... 510/443, 452, 510/299, 475, 499, 503, 504, 528

[56] References Cited

U.S. PATENT DOCUMENTS

| | | | |
|---|---|---|---|
| 3,718,597 | 2/1973 | Werdehausen et al. | 510/303 |
| 3,912,681 | 10/1975 | Dickson | 260/29.6 |
| 3,948,838 | 4/1976 | Hinton, Jr. et al. | 260/29.4 |
| 4,235,735 | 11/1980 | Marco et al. | 252/174.18 |
| 4,548,744 | 10/1985 | Connor | 252/545 |
| 4,559,056 | 12/1985 | Leigh et al. | 8/115.64 |
| 4,579,681 | 4/1986 | Ruppert et al. | 252/542 |
| 4,597,898 | 7/1986 | Vander Meer | 252/529 |
| 4,614,519 | 9/1986 | Ruppert et al. | 8/137 |
| 4,661,288 | 4/1987 | Rubingh et al. | 510/352 |
| 4,664,848 | 5/1987 | Oh et al. | 510/350 |
| 4,676,921 | 6/1987 | Van der Meer | 510/350 |
| 4,689,167 | 8/1987 | Collins et al. | 510/299 |
| 4,877,896 | 10/1989 | Maldonado et al. | 560/14.8 |
| 4,891,160 | 1/1990 | Vander Meer | 252/545 |
| 4,976,879 | 12/1990 | Maldonado et al. | 252/8.7 |
| 5,133,924 | 7/1992 | Appel et al. | 264/342 R |
| 5,160,657 | 11/1992 | Bortolotti et al. | 252/174.14 |
| 5,205,958 | 4/1993 | Swatling et al. | 252/174.13 |
| 5,366,652 | 11/1994 | Capeci et al. | 252/89.1 |
| 5,415,807 | 5/1995 | Gosselink et al. | 252/174.21 |
| 5,486,303 | 1/1996 | Capeci et al. | 252/89.1 |
| 5,565,145 | 10/1996 | Watson et al. | 510/350 |
| 5,747,440 | 5/1998 | Kellett et al. | 510/276 |
| 5,929,010 | 7/1999 | Kellett et al. | 510/276 |
| 5,968,893 | 10/1999 | Mandhar et al. | 510/475 |

FOREIGN PATENT DOCUMENTS

| | | | |
|---|---|---|---|
| 0 206 513 | 12/1986 | European Pat. Off. | C11D 3/30 |
| 0 215 637 | 3/1987 | European Pat. Off. | C11D 11/02 |
| 0 273 688 | 7/1988 | European Pat. Off. | C11D 11/02 |
| 0 351 937 B1 | 2/1994 | European Pat. Off. | C11D 11/00 |
| 0 618 289 A1 | 10/1994 | European Pat. Off. | C11D 17/06 |
| 0 622 454 A1 | 11/1994 | European Pat. Off. | C11D 17/06 |
| 0 451 894 B1 | 5/1995 | European Pat. Off. | C11D 10/04 |
| 0 688 862 A1 | 12/1995 | European Pat. Off. | C11D 17/02 |
| 28 29 022 A1 | 1/1980 | Germany | D06M 13/46 |
| 06313271 | 11/1994 | Japan | D06M 15/07 |
| 1 314 897 | 4/1973 | United Kingdom | C11D 3/22 |
| 1 498 520 | 1/1978 | United Kingdom | C11D 10/00 |
| 1 517 713 | 7/1978 | United Kingdom | C11D 17/06 |
| 1 537 288 | 12/1978 | United Kingdom | C11D 10/02 |
| WO 95/32272 | 11/1995 | WIPO | C11D 3/37 |
| WO 98/08928 | 3/1998 | WIPO | C11D 11/02 |

*Primary Examiner*—Lorna M. Douyon
*Attorney, Agent, or Firm*—Brian M. Bolam; Kim William Zerby; Jacobus C. Rasser

[57] ABSTRACT

A process is provided in which selected modified polyamines are incorporated into fully formulated detergent compositions in a manner that unexpectedly results in enhanced cleaning performance. The process involves premixing the modified polyamine with a detersive surfactant or acid precursor thereof, and thereafter, adding adjunct ingredients such as builders and water. The entire mixture is then spray dried to form spray-dried granular detergent composition.

18 Claims, No Drawings

SPRAY DRYING PROCESS FOR PRODUCING DETERGENT COMPOSITIONS INVOLVING PREMIXING MODIFIED POLYAMINE POLYMERS

This application claims the benefit of U.S. Provisional Application Ser. No. 60/026,900, filed Aug. 26, 1996.

FIELD OF THE INVENTION

The present invention relates to a spray drying process for producing laundry detergent compositions that contain modified polyamines especially useful as cotton soil release and dispersant agents. More specifically, the process involves premixing the modified polyamine with a surfactant paste or precursor thereof prior to subsequent addition and mixing of adjunct detergent ingredients. The overall mixture is thereafter subjected to a spray drying process so as to provide a spray-dried detergent composition having improved performance.

BACKGROUND OF THE INVENTION

Various fabric surface modifying agents have been commercialized and are currently used in detergent compositions and fabric softener/antistatic articles and compositions. Examples of surface modifying agents are soil release polymers. Soil release polymers typically comprise an oligomeric or polymeric ester "backbone" and are generally very effective on polyester or other synthetic fabrics where the grease or similar hydrophobic stains form an attached film and are not easily removed in an aqueous laundering process. The soil release polymers have a less dramatic effect on "blended" fabrics, that is, on fabrics that comprise a mixture of cotton and synthetic material, and have little or no effect on cotton articles.

Extensive research in this area has yielded significant improvements in the effectiveness of polyester soil release agents yielding materials with enhanced product performance and capability of being incorporated into detergent formulations. Modifications of the polymer backbone as well as the selection of proper end-capping groups have produced a wide variety of polyester soil release polymers. For example, end-cap modifications, such as the use of sulfoaryl moieties and especially the low cost isethionate-derived end-capping units, have increased the range of solubility and adjunct ingredient compatibility of these polymers without sacrifice to soil release effectiveness. Many polyester soil release polymers can now be formulated into both liquid as well as solid (i.e., granular) detergents.

As in the case of polyester soil release agents, producing an oligomeric or polymeric material that mimics the structure of cotton has not resulted in a cotton soil release polymer. Although cotton and polyester fabric are both comprised of long chain polymeric materials, they are chemically very different. Cotton is comprised of cellulose fibers that consist of anhydroglucose units joined by 1–4 linkages. These glycosidic linkages characterize the cotton cellulose as a polysaccharide whereas polyester soil release polymers are generally a combination of terephthalate and ethylene/propylene oxide residues. These differences in composition account for the difference in the fabric properties of cotton versus polyester fabric. Cotton is hydrophilic relative to polyester. Polyester is hydrophobic and attracts oily or greasy dirt and can be easily "dry cleaned". Importantly, the terephthalate and ethyleneoxy/propyleneoxy backbone of polyester fabric does not contain reactive sites, such as the hydroxyl moieties of cotton, that react with stains in a different manner than synthetics. Many cotton stains become "fixed" and can only be resolved by bleaching the fabric.

Until recently, the development of effective fabric surface modifying agents for use on cotton fabrics has been elusive. Attempts by others to apply the paradigm of matching the structure of a soil release polymer with the structure of the fabric, a method successful in the polyester soil release polymer field, have nevertheless yielded marginal results when applied to other fabric surface modifying agents, especially for cotton fabrics. For example, the use of methylcellulose, a cotton polysaccharide with modified oligomeric units, proved to be more effective on polyesters than on cotton.

Additionally, detergent formulators have been faced with the task of devising products to remove a broad spectrum of soils and stains from fabrics. The varieties of soils and stains ranges within a spectrum spanning from polar soils, such as proteinaceous, clay, and inorganic soils, to non-polar soils, such as soot, carbon-black, by-products of incomplete hydrocarbon combustion, and organic soils. To that end, detergent compositions have become more complex as formulators attempt to provide products which handle all types of such soils concurrently. Formulators have been highly successful in developing traditional dispersants which are particularly useful in suspending polar, highly charged, hydrophilic particles such as clay. As yet, however, dispersants designed to disperse and suspend non-polar, hydrophobic-type soils and particulates have been more difficult to develop.

It has been surprisingly discovered that effective soil release agents for cotton articles and dispersants can be prepared from certain modified polyamines. This unexpected result has yielded compositions that are key to providing these benefits once available to only synthetic and synthetic-cotton blended fabric. However, the manner in which such modified polyamines may be included into fully formulated detergent compositions so as to retain, and preferably, improve performance has remained unresolved. Detergent compositions which contain these modified polyamines and are produced via prior art processes do not perform at the desired level of performance. Accordingly, there remains a need in the art for a detergent-making process which provides a means by which selected modified polyamines can be incorporated into fully formulated detergent compositions that have enhanced cleaning performance.

BACKGROUND ART

U.K. 1,314,897, published Apr. 26, 1973 teaches a hydroxypropyl methyl cellulose material for the prevention of wet-soil redeposition and improving stain release on laundered fabric. U.S. Pat. No. 3,897,026 issued to Kearney, discloses cellulosic textile materials having improved soil release and stain resistance properties obtained by reaction of an ethylene-maleic anhydride co-polymer with the hydroxyl moieties of the cotton polymers. U.S. Pat. No. 3,912,681 issued to Dickson teaches a composition for applying a non-permanent soil release finish comprising a polycarboxylate polymer to a cotton fabric. U.S. Pat. No. 3,948,838 issued to Hinton, et alia describes high molecular weight (500,000 to 1,500,000) polyacrylic polymers for soil release. U.S. Pat. No. 4,559,056 issued to Leigh, et alia discloses a process for treating cotton or synthetic fabrics with a composition comprising an organopolysiloxane elastomer, an organosiloxaneoxyalkylene copolymer crosslinking agent and a siloxane curing catalyst. See also U.S. Pat. Nos. 4,579,681 and 4,614,519. These disclose vinyl caprolactam materials have their effectiveness limited to polyester fabrics, blends of cotton and polyester, and cotton fabrics rendered hydrophobic by finishing agents.

In addition to the above cited art, the following disclose various soil release polymers or modified polyamines; U.S. Pat. No. 4,548,744, Connor, issued Oct. 22, 1985; U.S. Pat. No. 4,597,898, Vander Meer, issued Jul. 1, 1986; U.S. Pat. No. 4,877,896, Maldonado, et al., issued Oct. 31, 1989; U.S. Pat. No. 4,891,160, Vander Meer, issued Jan. 2, 1990; U.S. Pat. No. 4,976,879, Maldonado, et al., issued Dec. 11, 1990; U.S. Pat. No. 5,415,807, Gosselink, issued May 16,1995; U.S. Pat. No. 4,235,735, Marco, et al., issued Nov. 25, 1980; U.K. Patent 1,537,288, published Dec. 29, 1978; U.K. Patent 1,498,520, published Jan. 18, 1978; WO 95/32272, published Nov. 30, 1995; European Patent Application 206, 513; German Patent DE 28 29 022, issued Jan. 10, 1980; Japanese Kokai JP 06313271, published Apr. 27, 1994.

The following patents and publications disclose detergent compositions containing made by spray drying processes: Appel et al, U.S. Pat. No. 5,133,924 (Lever); Bortolotti et al, U.S. Pat. No. 5,160,657 (Lever); Johnson et al, British patent No. 1,517,713 (Unilever); and Curtis, European Patent Application 451,894.

SUMMARY OF THE INVENTION

The aforementioned needs in the art are met by the present invention which provides a process in which selected modified polyamines that serve as soil release and/or dispersant agents are incorporated into fully formulated detergent compositions which unexpectedly exhibit enhanced dispersancy and cleaning performance, especially relative to cotton-containing fabrics. In essence, the process invention involves premixing the modified polyamine with a detersive surfactant or precursor thereof, and thereafter, adding adjunct ingredients such as builders and water. The entire mixture is then spray dried to form a spray-dried granular detergent composition.

In accordance with one aspect of the invention, a process for a spray-dried granular detergent composition is provided. The process comprises the steps of: (a) premixing a detersive surfactant paste and a water-soluble or dispersible, modified polyamine in a mixer, the modified polyamine having a polyamine backbone corresponding to the formula:

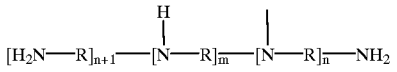

having a modified polyamine formula $V_{(n+1)}W_mY_nZ$ or a polyamine backbone corresponding to the formula:

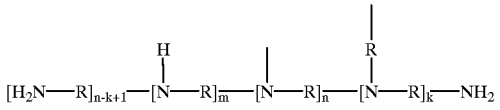

having a modified polyamine formula $V_{(n-k+1)}W_mY_nY'_kZ$, wherein k is less than or equal to n, the polyamine backbone prior to modification has a molecular weight greater than about 200 daltons, wherein i) V units are terminal units having the formula:

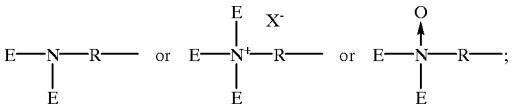

ii) W units are backbone units having the formula:

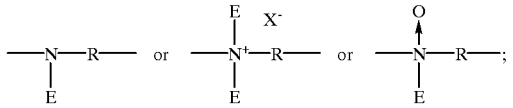

iii) Y units are branching units having the formula:

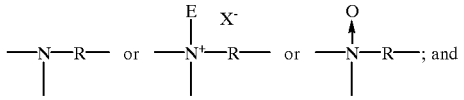

iv) Z units are terminal units having the formula:

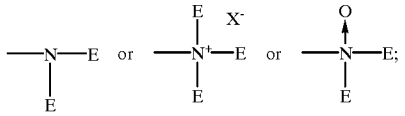

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, —$(R^1O)_xR^1$—, —$(R^1O)_xR^5(OR^1)_x$—, —$(CH_2CH(OR^2)CH_2O)_z(R^1O)_yR^1(OCH_2CH(OR^2)CH_2)_w$—, —$C(O)(R^4)_rC(O)$—, —$CH_2CH(OR^2)CH_2$—, and mixtures thereof; wherein $R^1$ is $C_2$–$C_6$ alkylene and mixtures thereof; $R^2$ is hydrogen, —$(R^1O)_xB$, and mixtures thereof; $R^3$ is $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; $R^4$ is $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is $C_1$–$C_{12}$ alkylene, $C_3$–$C_{12}$ hydroxyalkylene, $C_4$–$C_{12}$ dihydroxy-alkylene, $C_8$–$C_{12}$ dialkylarylene, —C(O)—, —$C(O)NHR^6NHC(O)$—, —$R^1(OR^1)$—, —$C(O)(R^4)_rC(O)$—, —$CH_2CH(OH)CH_2$—, —$CH_2CH(OH)CH_2O(R^1O)_yR^1OCH_2CH(OH)CH_2$—, and mixtures thereof; $R^6$ is $C_2$–$C_{12}$ alkylene or $C_6$–$C_{12}$ arylene; E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_xB$, —$C(O)R^3$, and mixtures thereof, oxide; B is hydrogen, $C_1$–$C_6$ alkyl, —$(CH_2)_qSO_3M$, —$(CH_2)_pCO_2M$, —$(CH_2)_q(CHSO_3M)CH_2SO_3M$, —$(CH_2)_q$—$(CHSO_2M)CH_2SO_3M$, —$(CH_2)_pPO_3M$, —$PO_3M$, and mixtures thereof; M is hydrogen or a water soluble cation in sufficient amount to satisfy charge balance; X is a water soluble anion; m has the value from 4 to about 400; n has the value from 0 to about 200; p has the value from 1 to 6, q has the value from 0 to 6; r has the value of 0 or 1; w has the value 0 or 1; x has the value from 1 to 100; y has the value from 0 to 100; z has the value 0 or i; and (b) mixing, subsequent to the premixing step, a detergent builder and water into the mixer to form a slurry; and (c) spray drying the slurry so as to form the spray-dried granular detergent composition.

In accordance with another aspect of the invention, another process for producing a spray-dried granular detergent composition is provided. This process comprises the steps of: (a) premixing an acid precursor of a detersive surfactant and a water-soluble or dispersible, modified polyamine in a mixer, wherein the modified polyamine has a polyamine backbone as described above; (b) neutralizing said acid precursor with a neutralizing agent which is added to said mixer; (c) mixing a detergent builder and water into the mixer to form a slurry; and (d) spray drying the slurry so as to form the spray-dried granular detergent composition. Also provided by the invention are the detergent compositions made by any of the processes described herein.

All documents cited herein are incorporated herein by reference. All percentages and proportions are on a weight basis unless otherwise indicated.

Accordingly, it is an object of the invention to provide a process for producing a granular detergent composition which provides a means by which selected modified polyamines can be incorporated into fully formulated detergent compositions. It is also an object of the invention to provide such a process which minimizes or eliminates degradation of the selected modified polyamines as a result of the fully formulated detergent-making process so as to provide enhanced cleaning performance. It is also an object to provide a process which lends itself to more efficient drying of the spray-dried granules and their processability. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The process of the instant invention involves premixing selected modified polyamines and a surfactant paste prior to, or during, the neutralization of the acid precursor thereof. While not intending to be bound by theory, it is believed that the selected modified polyamines described more fully hereinafter form a complex with the detersive surfactant in the surfactant paste or liquid acid precursor thereof. In order to achieve the maximum benefits of the process, the surfactant paste will preferably comprise an anionic surfactant, and optionally a nonionic surfactant, but preferably will not contain a cationic surfactant. This polyamine/surfactant complex typically has a higher oxidative degradation temperature as compared to the degradation temperature of the modified polyamines by themselves. As a consequence of this complex formation, the selected modified polyamines unexpectedly results in improved performance of the fully formulated granular detergent composition into which these modified polyamines are incorporated.

To this end, the modified polyamine and anionic surfactant paste or acid precursor thereof is mixed in an in-line static mixer or a conventional mixer (e.g., crutcher) for at least about 1 minute. The temperature at which the premixing step using the surfactant paste is performed typically is at a temperature of from about 25° C. to about 80° C. Also, it is preferred to maintain the pH of the premix at from about 8 to about 10 without other detergent ingredients other than the surfactant paste and modified polyamine. In the case of the use of an acid precursor, the initial pH before neutralization is typically from about 1 to about 3 and the temperature is typically from about 40° C. to about 70° C.

The modified polyamine is preferably present in an amount of from about 0.01% to about 10%, more preferably from about 0.05% to about 5%, and most preferably from about 0.1% to about 1.0%, by weight of the overall granular detergent composition. Further, in the premixing step, the detersive surfactant paste preferably comprises from about 1% to about 70%, more preferably from about 20% to about 60%, and most preferably from about 25% to about 50%, by weight of surfactant and the balance water and other minor ingredients. The preferred surfactant in the paste include at least one of the anionic surfactants detailed hereinafter. The process provides a granular detergent composition that unexpectedly exhibits improved cleaning performance as opposed to direct addition of the modified polyamine to the composition.

In the embodiment of the acid precursor process, the acid precursor of the surfactant (if the paste is not used) is neutralized with a neutralizing agent, preferably selected from the group consisting of sodium hydroxide, sodium carbonate, sodium silicate and mixtures thereof. The neutralizing agent is added to the mixer during the process. For example, the acid precursor used in the process can be an acid precursor for linear alkylbenzene sulfonate surfactant ("HLAS"). If the surfactant paste is used, the neutralization step is not necessary, and the next step of the process involves mixing a detergent builder and water with the premixed surfactant paste to form a slurry. This step can be completed by adding the builders, water and other ingredients directly to the mixing apparatus used in the premixing step (e.g. crutcher) or in a separate mixer to which the premixed ingredients have been previously added. Preferably, the detergent builder is selected from the group consisting of aluminosilicates, carbonates, phosphates and mixtures thereof.

In the final essential step of the process, the slurry is spray dried to form a spray-dried granular detergent composition. This step can be completed in a conventional spray drying tower operated at an inlet temperature range of from about 180° C. to about 420° C. Such known apparatus operates by spraying the slurry via nozzles into a counter-current (or co-current) stream of hot air which ultimately forms porous spray-dried granules.

Optionally, adjunct detergent ingredients can be added during the mixing step. By way of example, adjunct detergent ingredients including inorganic salts such as sodium sulfate, sodium tripolyphosphate and mixtures thereof can be added. Further, adjunct ingredients selected from the group consisting of silicates, optical brighteners, colorants, antiredeposition agents, fillers and mixtures thereof also may be included during the premixing step or at other appropriate locations in the process. Another optional step in the process involves adding steam to mixer prior to the spray drying step.

Modified Polyamines

The modified polyamines used in the process invention are water-soluble or dispersible, especially useful for cleaning cotton-containing fabrics or as a dispersant. These polyamines comprise backbones that can be either linear or cyclic. The polyamine backbones can also comprise polyamine branching chains to a greater or lesser degree. In general, the polyamine backbones described herein are modified in such a manner that each nitrogen of the polyamine chain is thereafter described in terms of a unit that is substituted. quaternized, oxidized, or combinations thereof.

For the purposes of the present invention the term "modification" is defined as replacing a backbone —NH hydrogen atom by an E unit (substitution), quaternizing a backbone nitrogen (quaternized) or oxidizing a backbone nitrogen to the N-oxide (oxidized). The terms "modification" and "substitution" are used interchangeably when referring to the process of replacing a hydrogen atom attached to a backbone nitrogen with an E unit. Quaternization or oxidation may take place in some circumstances without substitution, but preferably substitution is accompanied by oxidation or quaternization of at least one backbone nitrogen.

The linear or non-cyclic polyamine backbones that comprise the modified polyamines have the general formula:

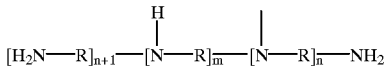

said backbones prior to subsequent modification, comprise primary, secondary and tertiary amine nitrogens connected by R "linking" units. The cyclic polyamine backbones comprising the modified polyamines used in the present invention have the general formula:

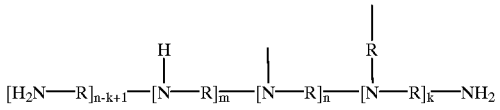

said backbones prior to subsequent modification, comprise primary, secondary and tertiary amine nitrogens connected by R "linking" units.

For the purpose of the present invention, primary amine nitrogens comprising the backbone or branching chain once modified are defined as V or Z "terminal" units. For example, when a primary amine moiety, located at the end of the main polyamine backbone or branching chain having the structure

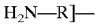

is modified according to the present invention, it is thereafter defined as a V "terminal" unit, or simply a V unit. However, for the purposes of the present invention, some or all of the primary amine moieties can remain unmodified subject to the restrictions further described herein below. These unmodified primary amine moieties by virtue of their position in the backbone chain remain "terminal" units. Likewise, when a primary amine moiety, located at the end of the main polyamine backbone having the structure

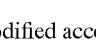

is modified according to the present invention, it is thereafter defined as a Z "terminal" unit, or simply a Z unit. This unit can remain unmodified subject to the restrictions further described herein below.

In a similar manner, secondary amine nitrogens comprising the backbone or branching chain once modified are defined as W "backbone" units. For example, when a secondary amine moiety, the major constituent of the backbones and branching chains of the present invention, having the structure

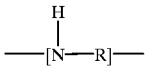

is modified according to the present invention, it is thereafter defined as a W "backbone" unit, or simply a W unit. However, for the purposes of the present invention, some or all of the secondary amine moieties can remain unmodified. These unmodified secondary amine moieties by virtue of their position in the backbone chain remain "backbone" units.

In a further similar manner, tertiary amine nitrogens comprising the backbone or branching chain once modified are further referred to as Y "branching" units. For example, when a tertiary amine moiety, which is a chain branch point of either the polyamine backbone or other branching chains or rings, having the structure

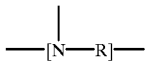

is modified according to the present invention, it is thereafter defined as a Y "branching" unit, or simply a Y unit. However, for the purposes of the present invention, some or all or the tertiary amine moieties can remain unmodified. These unmodified tertiary amine moieties by virtue of their position in the backbone chain remain "branching" units. The R units associated with the V, W and Y unit nitrogens which serve to connect the polyamine nitrogens, are described herein below.

The final modified structure of the polyamines of the present invention can be therefore represented by the general formula $$V_{(n+1)}W_mY_nZ$$

for linear polyamine polymers and by the general formula $$V_{(n-k+1)}W_mY_nY'_kZ$$

for cyclic polyamine polymers. For the case of polyamines comprising rings, a Y' unit of the formula

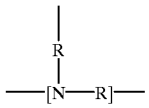

serves as a branch point for a backbone or branch ring. For every Y' unit there is a Y unit having the formula

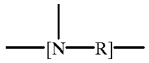

that will form the connection point of the ring to the main polymer chain or branch. In the unique case where the backbone is a complete ring, the polyamine backbone has the formula

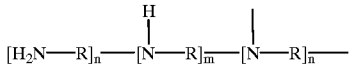

therefore comprising no Z terminal unit and having the formula $$V_{n-k}W_mY_nY'_k$$

wherein k is the number of ring forming branching units. Preferably the polyamine backbones of the present invention comprise no rings.

In the case of non-cyclic polyamines, the ratio of the index n to the index m relates to the relative degree of branching. A fully non-branched linear modified polyamine according to the present invention has the formula $$VW_mZ$$

that is, n is equal to 0. The greater the value of n (the lower the ratio of m to n), the greater the degree of branching in the molecule. Typically the value for m ranges from a minimum value of 4 to about 400, however larger values of m, especially when the value of the index n is very low or nearly 0, are also preferred.

Each polyamine nitrogen whether primary, secondary or tertiary, once modified according to the present invention, is further defined as being a member of one of three general classes; simple substituted, quaternized or oxidized. Those polyamine nitrogen units not modified are classed into V, W, Y, or Z units depending on whether they are primary, secondary or tertiary nitrogens. That is unmodified primary amine nitrogens are V or Z units, unmodified secondary amine nitrogens are W units and unmodified tertiary amine nitrogens are Y units for the purposes of the present invention.

Modified primary amine moieties are defined as V "terminal" units having one of three forms:

a) simple substituted units having the structure:

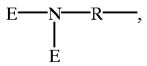

b) quaternized units having the structure:

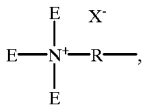

wherein X is a suitable counter ion providing charge balance; and c) oxidized units having the structure:

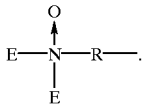

Modified secondary amine moieties are defined as W "backbone" units having one of three forms:

a) simple substituted units having the structure:

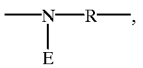

b) quaternized units having the structure:

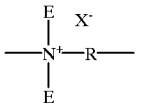

wherein X is a suitable counter ion providing charge balance; and c) oxidized units having the structure:

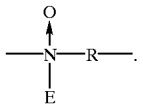

Modified tertiary amine moieties are defined as Y "branching" units having one of three forms:

a) unmodified units having the structure:

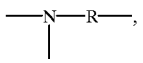

b) quaternized units having the structure:

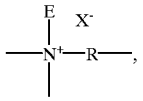

wherein X is a suitable counter ion providing charge balance; and c) oxidized units having the structure:

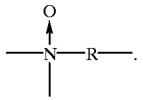

Certain modified primary amine moieties are defined as Z "terminal" units having one of three forms:

a) simple substituted units having the structure:

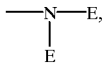

b) quaternized units having the structure:

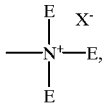

wherein X is a suitable counter ion providing charge balance; and c) oxidized units having the structure:

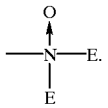

When any position on a nitrogen is unsubstituted of unmodified, it is understood that hydrogen will substitute for E. For example, a primary amine unit comprising one E unit in the form of a hydroxyethyl moiety is a V terminal unit having the formula $(HOCH_2CH_2)HN$—.

For the purposes of the present invention there are two types of chain terminating units, the V and Z units. The Z "terminal" unit derives from a terminal primary amino moiety of the structure —$NH_2$. Non-cyclic polyamine backbones according to the present invention comprise only one Z unit whereas cyclic polyamines can comprise no Z units. The Z "terminal" unit can be substituted with any of the E units described further herein below, except when the Z unit is modified to form an N-oxide. In the case where the Z unit nitrogen is oxidized to an N-oxide, the nitrogen must be modified and therefore E cannot be a hydrogen.

The polyamines of the present invention comprise backbone R "linking" units that serve to connect the nitrogen atoms of the backbone. R units comprise units that for the purposes of the present invention are referred to as "hydrocarbyl R" units and "oxy R" units. The "hydrocarbyl" R units are $C_2$–$C_{12}$ alkylene, $C_4$–$C_{12}$ alkenylene, $C_3$–$C_{12}$ hydroxyalkylene wherein the hydroxyl moiety may take any position on the R unit chain except the carbon atoms directly connected to the polyamine backbone nitrogens; $C_4$–$C_{12}$ dihydroxyalkylene wherein the hydroxyl moieties may occupy any two of the carbon atoms of the R unit chain except those carbon atoms directly connected to the polyamine backbone nitrogens; $C_8$–$C_{12}$ dialkylarylene which for the purpose of the present invention are arylene moieties having two alkyl substituent groups as part of the linking chain. For example, a dialkylarylene unit has the formula

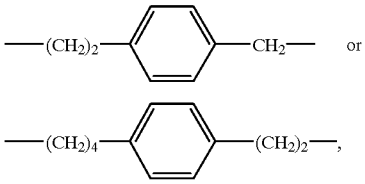

although the unit need not be 1,4-substituted, but can also be 1,2 or 1,3 substituted $C_2$–$C_{12}$ alkylene, preferably ethylene, 1,2-propylene, and mixtures thereof, more preferably ethylene. The "oxy" R units comprise —$(R^1O)_xR^5(OR^1)_x$—, —$CH_2CH(OR^2)CH_2O)_z(R^1O)_yR^1(OCH_2CH(OR^2)CH_2)_w$—, —$CH_2CH(OR^2)CH_2$—, —$(R^1O)_xR^1$—, and mixtures thereof. Preferred R units are $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, —$(R^1O)_xR$—, —$CH_2CH(OR^2)CH_2$—, —$(CH_2CH(OH)CH_2O)_z(R^1O)_yR^1(OCH_2CH$—$(OH)CH_2)_w$—, —$(R^1O)_xR^5(OR^1)_x$—, more preferred R units are $C_2$–$C_{12}$ alkylene, $C_3$–$C_{12}$ hydroxyalkylene, $C_4$–$C_{12}$ dihydroxyalkylene, —$(R^1O)_xR^1$—, —$(R^1O)_xR^5(OR^1)_x$—, —$(CH_2CH(OH)CH_2O)_z(R^1O)_yR^1(OCH_2CH$—$(OH)CH_2)_w$—, and mixtures thereof, even more preferred R units are $C_2$–$C_{12}$ alkylene, $C_3$ hydroxyalkylene, and mixtures thereof, most preferred are $C_2$–$C_6$ alkylene. The most preferred backbones of the present invention comprise at least 50% R units that are ethylene.

RI units are $C_2$–$C_6$ alkylene, and mixtures thereof, preferably ethylene. $R^2$ is hydrogen, and —$(R^1O)_xB$, preferably hydrogen.

$R^3$ is $C_1$–$C_{18}$ alkyl, $C_7$–$C_{12}$ arylalkylene, $C_7$–$C_{12}$ alkyl substituted aryl, $C_6$–$C_{12}$ aryl, and mixtures thereof, preferably $C_1$–$C_{12}$ alkyl, $C_7$–$C_{12}$ arylalkylene, more preferably $C_1$–$C_{12}$ alkyl, most preferably methyl. $R^3$ units serve as part of E units described herein below.

$R^4$ is $C_1$–$C_{12}$ alkylene, $C_4$–$C_{12}$ alkenylene, $C_8$–$C_{12}$ arylalkylene, $C_6$–$C_{10}$ arylene, preferably $C_1$–$C_{10}$ alkylene, $C_8$–$C_{12}$ arylalkylene, more preferably $C_2$–$C_8$ alkylene, most preferably ethylene or butylene.

$R^5$ is $C_1$–$C_{12}$ alkylene, $C_3$–$C_{12}$ hydroxyalkylene, $C_4$–$C_{12}$ dihydroxyalkylene, $C_8$–$C_{12}$ dialkylarylene, —C(O)—, —$C(O)NHR^6NHC(O)$—, —$C(O)(R^4)_rC(O)$—, —$R^1(OR^1)$—, —$CH_2CH(OH)CH_2O(R^1O)_yR^1OCH_2CH(OH)CH_2$—, —$C(O)(R^4)_rC(O)$—, —$CH_2CH(OH)CH_2$—, $R^5$ is preferably ethylene, —C(O)—, —$C(O)NHR^6NHC(O)$—, —$R^1(OR^1)$—, —$CH_2CH(OH)CH_2$—, —$CH_2CH(OH)CH_2O(R^1O)_yR^1OCH_2CH$—$(OH)CH_2$—, more preferably —$CH_2CH(OH)CH_2$—.

$R^6$ is $C_2$–$C_{12}$ alkylene or $C_6$–$C_{12}$ arylene.

The preferred "oxy" R units are further defined in terms of the $R^1$, $R^2$, and $R^5$ units. Preferred "oxy" R units comprise the preferred $R^1$, $R^2$, and $R^5$ units. The preferred modified polyamines comprise at least 50% $R^1$ units that are ethylene. Preferred $R^1$, $R^2$, and $R^5$ units are combined with the "oxy" R units to yield the preferred "oxy" R units in the following manner.

i) Substituting more preferred $R^5$ into —$(CH_2CH_2O)_xR^5(OCH_2CH_2)_x$— yields —$(CH_2CH_2O)_xCH_2CHOHCH_2(OCH_2CH_2)_x$—.

ii) Substituting preferred $R^1$ and $R^2$ into —$(CH_2CH(OR^2)CH_2O)_z$—$(R^1O)_yR^1O(CH_2CH(OR^2)CH_2)_w$— yields —$(CH_2CH(OH)CH_2O)_z$—$(CH_2CH_2O)_yCH_2CH_2O(CH_2CH(OH)CH_2)_w$—.

iii) Substituting preferred $R^2$ into —$CH_2CH(OR^2)CH_2$— yields —$CH_2CH(OH)CH_2$—.

E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_mB$, —$C(O)R^3$, preferably hydrogen, $C_2$–$C_{22}$ hydroxyalkylene, benzyl, $C_1$–$C_{22}$ alkylene, —$(R^1O)_mB$, —$C(O)R^3$, —$(CH_2)_pCO_2M$, —$(CH_2)_qSO_3M$, —$CH(CH_2CO_2M)CO_2M$, more preferably $C_1$–$C_{22}$ alkylene, —$(R^1O)_xB$, —$C(O)R^3$, —$(CH_2)_pCO_2M$, —$(CH_2)_qSO_3M$, —$CH(CH_2CO_2M)CO_2M$, most preferably $C_1$–$C_{22}$ alkylene, —$(R^1O)_xB$, and —$C(O)R^3$. When no modification or substitution is made on a nitrogen then hydrogen atom will remain as the moiety representing E.

E units do not comprise hydrogen atom when the V, W or Z units are oxidized, that is the nitrogens are N-oxides. For example, the backbone chain or branching chains do not comprise units of the following structure:

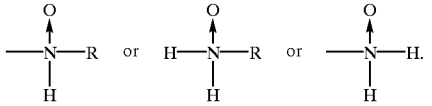

Additionally, E units do not comprise carbonyl moieties directly bonded to a nitrogen atom when the V, W or Z units are oxidized, that is, the nitrogens are N-oxides. According to the present invention, the E unit —$C(O)R^3$ moiety is not bonded to an N-oxide modified nitrogen, that is, there are no N-oxide amides having the structure

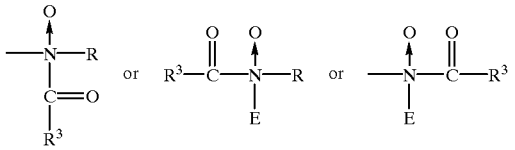

or combinations thereof.

B is hydrogen, $C_1$–$C_6$ alkyl, —$(CH_2)_qSO_3M$, —$(CH_2)_pCO_2M$, —$(CH_2)_q$—$(CHSO_3M)CH_2SO_3M$, —$(CH_2)_q(CHSO_2M)CH_2SO_3M$, —$(CH_2)_pPO_3M$, —$PO_3M$, preferably hydrogen, —$(CH_2)_qSO_3M$, —$(CH_2)_q(CHSO_3M)$ $CH_2SO_3M$, $—(CH_2)_q—(CHSO_2M)CH_2SO_3M$, more preferably hydrogen or $—(CH_2)_qSO_3M$.

M is hydrogen or a water soluble cation in sufficient amount to satisfy charge balance. For example, a sodium cation equally satisfies $—(CH_2)_pCO_2M$, and $—(CH_2)_qSO_3M$ thereby resulting in $—(CH_2)_pCO_2Na$, and $—(CH_2)_qSO_3Na$ moieties. More than one monovalent cation, (sodium, potassium, etc.) can be combined to satisfy the required chemical charge balance. However, more than one anionic group may be charge balanced by a divalent cation or more than one mono-valent cation may be necessary to satisfy the charge requirements of a poly-anionic radical. For example, a $—(CH_2)_pPO_3M$ moiety substituted with sodium atoms has the formula $—(CH_2)_pPO_3Na_3$. Divalent cations such as calcium ($Ca^{2+}$) or magnesium ($Mg^{2+}$) may be substituted for or combined with other suitable mono-valent water soluble cations. Preferred cations are sodium and potassium, more preferred is sodium.

X is a water soluble anion such as chlorine ($Cl^-$), bromine ($Br^-$) and iodine ($I^-$) or X can be any negatively charged radical such as sulfate ($SO_4^{2-}$) and methosulfate ($CH_3SO_3^-$).

The formula indices have the following values: p has the value from 1 to 6, q has the value from 0 to 6; r has the value 0 or 1; w has the value 0 or 1, x has the value from 1 to 100; y has the value from 0 to 100; z has the value 0 or 1; k is less than or equal to the value of n; m has the value from 4 to about 400, n has the value from 0 to about 200; m+n has the value of at least 5.

The preferred modified polyamines used in the present invention comprise polyamine backbones wherein less than about 50% of the R groups comprise "oxy" R units, preferably less than about 20%, more preferably less than 5%, most preferably the R units comprise no "oxy" R units.

The most preferred polyamines which comprise no "oxy" R units comprise polyamine backbones wherein less than 50% of the R groups comprise more than 3 carbon atoms. For example, ethylene, 1,2-propylene, and 1,3-propylene comprise 3 or less carbon atoms and are the preferred "hydrocarbyl" R units. That is when backbone R units are $C_2$–$C_{12}$ alkylene, preferred is $C_2$–$C_3$ alkylene, most preferred is ethylene.

The polyamines of the present invention comprise modified homogeneous and non-homogeneous polyamine backbones, wherein 100% or less of the —NH units are modified. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone which are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention. A polyamine backbone comprising all ethylene R units wherein no branching Y units are present is a homogeneous backbone. A polyamine backbone comprising all ethylene R units is a homogeneous backbone regardless of the degree of branching or the number of cyclic branches present.

For the purposes of the present invention the term "non-homogeneous polymer backbone" refers to polyamine backbones that are a composite of various R unit lengths and R unit types. For example, a non-homogeneous backbone comprises R units that are a mixture of ethylene and 1,2-propylene units. For the purposes of the present invention a mixture of "hydrocarbyl" and "oxy" R units is not necessary to provide a non-homogeneous backbone. The proper manipulation of these "R unit chain lengths" provides the formulator with the ability to modify the solubility and fabric substantivity of the modified polyamines.

Preferred polyamines of the present invention comprise homogeneous polyamine backbones that are totally or partially substituted by polyethyleneoxy moieties, totally or partially quaternized amines, nitrogens totally or partially oxidized to N-oxides, and mixtures thereof. However, not all backbone amine nitrogens must be modified in the same manner, the choice of modification being left to the specific needs of the formulator. The degree of ethoxylation is also determined by the specific requirements of the formulator.

The preferred polyamines that comprise the backbone of the compounds of the present invention are generally polyalkyleneamines (PAA's), polyalkyleneimines (PAI's), preferably polyethyleneamine (PEA's), polyethyleneimines (PEI's), or PEA's or PEI's connected by moieties having longer R units than the parent PAA's, PAI's, PEA's or PEI's. A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and teraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

Preferred amine polymer backbones comprise R units that are $C_2$ alkylene (ethylene) units, also known as polyethylenimines (PEI's). Preferred PEI's have at least moderate branching, that is the ratio of m to n is less than 4:1, however PEI's having a ratio of m to n of about 2:1 are most preferred. Preferred backbones, prior to modification have the general formula:

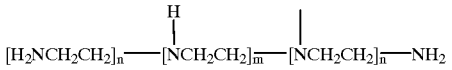

wherein m and n are the same as defined herein above. Preferred PEI's, prior to modification, will have a molecular weight greater than about 200 daltons.

The relative proportions of primary, secondary and tertiary amine units in the polyamine backbone, especially in the case of PEI's, will vary, depending on the manner of preparation. Each hydrogen atom attached to each nitrogen atom of the polyamine backbone chain represents a potential site for subsequent substitution, quaternization or oxidation.

These polyamines can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Examples of modified polyamines of the present invention comprising PEI's, are illustrated in Formulas I–IV:

Formula I depicts a polymer comprising a PEI backbone wherein all substitutable nitrogens are modified by replacement of hydrogen with a polyoxyalkyleneoxy unit, —$(CH_2CH_2O)_7H$, having the formula Formula III depicts a polymer comprising a PEI backbone wherein all backbone hydrogen atoms are substituted and some backbone amine units are quaternized. The substituents are polyoxyalkyleneoxy units, —$(CH_2CH_2O)_7H$, or methyl groups. The modified PEI polymer has the formula Formula I

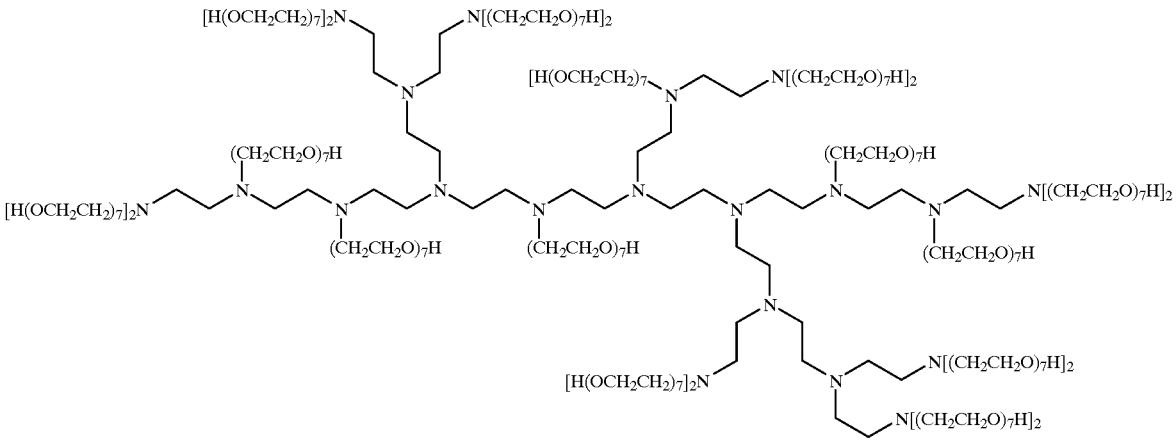

This is an example of a polymer that is fully modified by one type of moiety.

Formula II depicts a polymer comprising a PEI backbone wherein all substitutable primary amine nitrogens are modified by replacement of hydrogen with a polyoxyalkyleneoxy unit, —$(CH_2CH_2O)_7H$, the molecule is then modified by subsequent oxidation of all oxidizable primary and secondary nitrogens to N-oxides, wherein the polymer has the formula Formula II

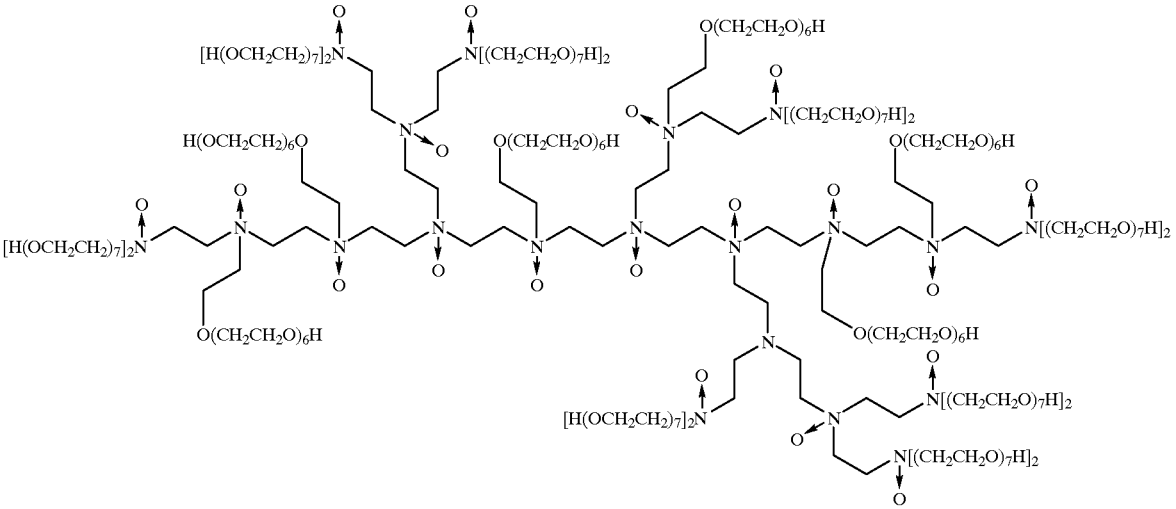

Formula III

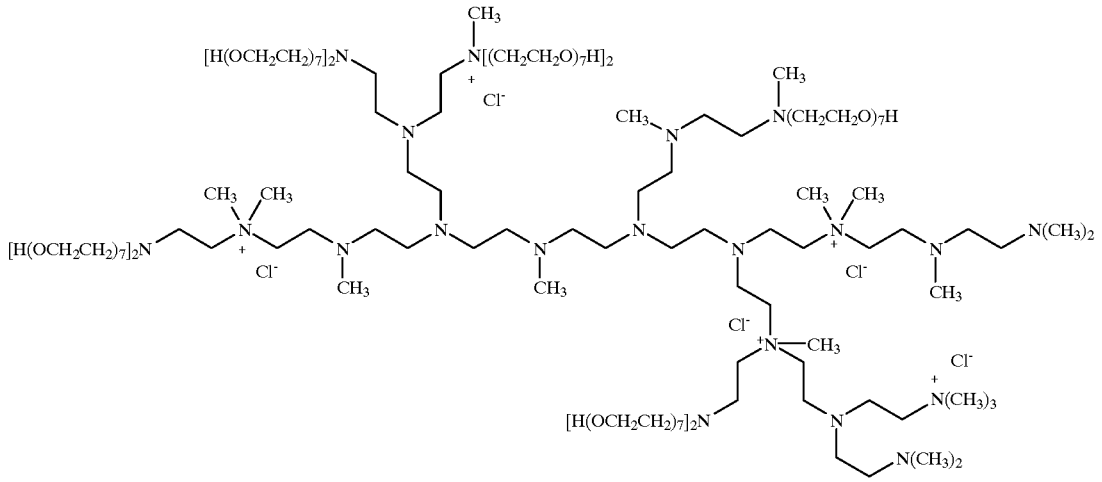

Formula IV depicts a polymer comprising a PEI backbone wherein the backbone nitrogens are modified by substitution (i.e. by —$(CH_2CH_2O)_7H$ or methyl), quaternized, oxidized to N-oxides or combinations thereof. The resulting polymer has the formula Formula IV

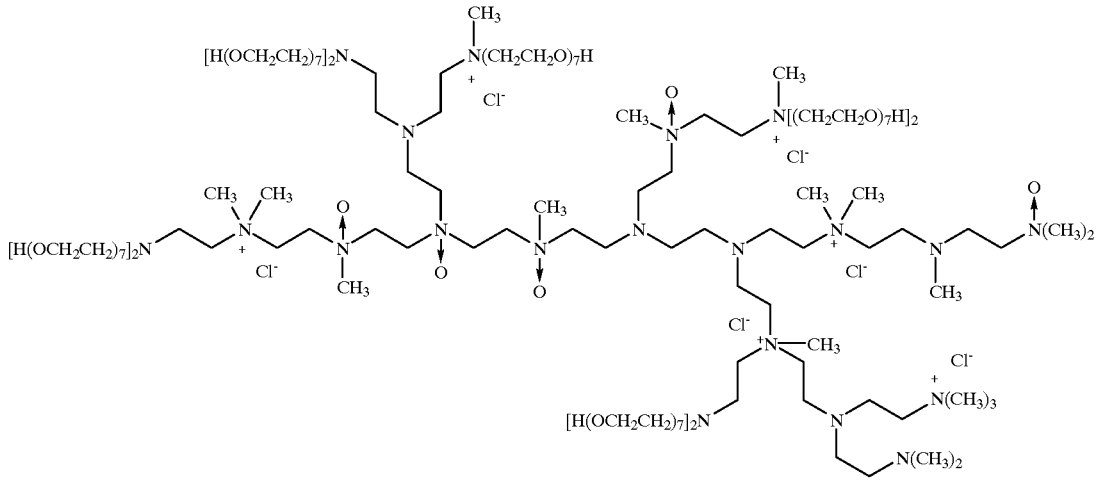

In the above examples, not all nitrogens of a unit class comprise the same modification. The present invention allows the formulator to have a portion of the secondary amine nitrogens ethoxylated while having other secondary amine nitrogens oxidized to N-oxides. This also applies to the primary amine nitrogens, in that the formulator may choose to modify all or a portion of the primary amine nitrogens with one or more substituents prior to oxidation or quaternization. Any possible combination of E groups can be substituted on the primary and secondary amine nitrogens, except for the restrictions described herein above.

Detersive Surfactant Paste or Acid Precursor

The process employs a surfactant paste which is premixed with the aforedescribed modified polyamine, wherein the surfactant paste preferably includes an anionic surfactant and water. Alternatively, the process may employ a liquid acid precursor of an anionic surfactant which is eventually neutralized in the process to contain the surfactant salt and water. Optionally, other structuring agents, viscosity modifiers and various other minors may be included in the surfactant paste or acid precursor thereof. Nonlimiting examples of anionic surfactants in the paste include the conventional $C_1$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("AEXS"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, and $C_{12}$–$C_{18}$ alpha-sulfonated fatty acid esters.

Optionally, adjunct conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), the $C_{10}$–$C_{18}$ alkyl polyglycosides and their corresponding sulfated polyglycosides, can also be included in the surfactant paste. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful.

Detergent Builders

Detergent builders are also employed in the process to provide fully formulated granular detergent compositions in which the builder controls the effects of mineral hardness during typical laundering operations. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Granular formulations typically comprise from about 10% to about 80%. more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6® is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5®, NaSKS-7® and NaSKS-11®, as the alpha, beta and gamma forms. As noted above, the delta-$Na_2SiO_5$ (NaSKS-6 form) is most preferred for use herein. Other silicates may also be useful such as for example magnesium silicate, which can serve as a crisping agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z[(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars and granules used for hand-laundering operations, the various alkali metal phosphates such as the well-known sodium tripolyphosphates, sodium pyrophosphate and sodium orthophosphate can be used. Phosphonate builders such as ethane-l-hydroxy-1,1-diphosphonate and other known phosphonates (see, for example, U.S. Pat. Nos. 3,159,581; 3,213,030; 3,422,021; 3,400,148 and 3,422,137) can also be used.

Adjunct Detergent Ingredients

One or more adjunct detergent ingredients can be incorporated in the detergent composition during subsequent steps of the present process invention. These adjunct ingredients include other surfactants such as cationic surfactants, other detergency builders, suds boosters or suds suppressers, anti-tarnish and anticorrosion agents, soil suspending agents, soil release agents, germicides, pH adjusting agents, non-builder alkalinity sources, chelating agents such as diethylene triamine penta acetic acid (DTPA) and diethylene triamine penta(methylene phosphonic acid), smectite clays, enzymes, enzyme-stabilizing agents, dye transfer inhibitors and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144, 226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLE I

Preparation of PEI 1800 $E_7$

This Example illustrates a method by which one of the selected modified polyamines is made. The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 750 g portion of polyethyleneimine (PEI) (Nippon Shokubai, Epomin SP-018 having a listed average molecular weight of 1800 equating to about 0.417 moles of polymer and 17.4 moles of nitrogen functions) is added to the autoclave. The autoclave is then sealed and purged of air (by applying vacuum to minus 28"Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Next, vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 4500 g of ethylene oxide (resulting in a total of 7 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 167 g methanesulfonic acid (1.74 moles). The reaction mixture is then deodorized by passing about 100 cu. ft. of inert gas (argon or nitrogen) through a gas dispersion frit and through the reaction mixture while agitating and heating the mixture to 130° C. The final reaction product is cooled slightly and collected in glass containers purged with nitrogen. In other preparations the neutralization and deodorization is accomplished in the reactor before discharging the product.

EXAMPLE II

Formation of amine oxide of PEI 1800 $E_7$

This Example illustrates another method by which one of the selected modified polyamines is made. To a 500 mL Erlenmeyer flask equipped with a magnetic stirring bar is added polyethyleneimine having a molecular weight of 1800 and ethoxylated to a degree of about 7 ethoxy groups per nitrogen (PEI-1800, $E_7$) (209 g, 0.595 mole nitrogen, prepared as in Example 1), and hydrogen peroxide (120 g of a 30 wt % solution in water, 1.06 mole). The flask is stopped, and after an initial exotherm the solution is stirred at room temperature overnight. 1H-NMR ($D_2O$) spectrum obtained on a sample of the reaction mixture indicates complete conversion. The resonances ascribed to methylene protons adjacent to unoxidized nitrogens have shifted from the original position at ~2.5 ppm to ~3.5 ppm. To the reaction solution is added approximately 5 g of 0.5% Pd on alumina pellets, and the solution is allowed to stand at room temperature for approximately 3 days. The solution is tested and found to be negative for peroxide by indicator paper. The material as obtained is suitably stored as a 51.1% active solution in water.

EXAMPLE III

Preparation of PEI 1200 $E_7$

This Example illustrates yet another method by which one of the selected modified polyamines is made. The ethoxylation is conducted in a 2 gallon stirred stainless steel autoclave equipped for temperature measurement and control, pressure measurement, vacuum and inert gas purging, sampling, and for introduction of ethylene oxide as a liquid. A -20 lb. net cylinder of ethylene oxide (ARC) is set up to deliver ethylene oxide as a liquid by a pump to the autoclave with the cylinder placed on a scale so that the weight change of the cylinder could be monitored. A 750 g portion of polyethyleneimine (PEI) ( having a listed average molecular weight of 1200 equating to about 0.625 moles of polymer and 17.4 moles of nitrogen functions) is added to the autoclave. The autoclave is then sealed and purged of air (by applying vacuum to minus 28"Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Next, vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about I hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 4500 g of ethylene oxide (resulting in a total of 7 moles of ethylene oxide per mole of PEI nitrogen function) is achieved over several hours, the temperature is increased to 110° C. and the mixture stirred for an additional hour. The reaction mixture is then collected in nitrogen purged containers and eventually transferred into a 22 L three neck round bottomed flask equipped with heating and agitation. The strong alkali catalyst is neutralized by adding 167 g methanesulfonic acid (1.74 moles). The reaction mixture is then deodorized by passing about 100 cu. ft. of inert gas (argon or nitrogen) through a gas dispersion frit and through the reaction mixture while agitating and heating the mixture to 130° C. The final reaction product is cooled slightly and collected in glass containers purged with nitrogen. In other preparations the neutralization and deodorization is accomplished in the reactor before discharging the product.

EXAMPLE IV

A modified polyamine is made in accordance with Example I ("PEI1800 E7") and used in the process of the current invention to form spray dried laundry granules. A spray-dried detergent composition is made without the PEI1800 E7 and a composition in which the PEI1800 E7 is not premixed (but added with other adjunct detergent ingredients) is made, both for purposes of comparison. All of the detergent-making process illustrated herein are executed in a conventional pilot scale system. The system contains a batch mixer (called a "crutcher") in which the premixing and mixing steps can be completed, followed by a conventional spray drying tower ("tower"). The PEI1800 E7 is added to the crutcher along with a sodium linear alkylbenzene sulfonate ("LAS") surfactant paste (30% LAS and balance water) which is premixed at 25° C. for about 5 minutes, wherein the pH of the premix is maintained at about 8 to 10. Thereafter, silicate, optical brightener, carboxymethyl cellulose ("CMC"), sodium carbonate, and water are added to the crutcher which is then mixed. Steam at a temperature of about 120° C., sodium sulfate and sodium tripolyphosphate are added to the crutcher as the contents are continuously mixed. The crutcher is operated in a batch mode, and contains 180 kg of wet crutcher mix per batch. In the tower, the wet crutcher mix is pumped under high pressure through atomizing nozzles to form a finely divided mist. A countercurrent flow of hot air (210° C.) is impinged upon the atomized mist, causing the drying of the mixture ultimately resulting in spray dried granules which are collected at the exit of the tower. Continuous operation of the spray drying tower is accomplished by using an intermediate tank which accumulates multiple batches from the crutcher and feeds in a continuous manner the spray drying tower. The spray-dried granules may be further processed, by adding additional detergent ingredients, if desired, to form a fully formulated laundry detergent composition.

The following spray-dried granular detergent compositions are made in accordance with the process invention (i.e. Compositions C and D) and processes outside the scope of the invention (i.e. Compositions A and B).

| Composition | PEI1800 E7 Weight % in finished granules | PEI1800 E7 Order of Addition |
|---|---|---|
| A | 0.0% | — |
| B | 1.0% | Last wet Ingredient |
| C | 1.0% | Premix with LAS First |
| D | 0.5% | Premix with LAS First |

Composition B is made via a process in which PEI1800 E7 is added as a last wet ingredient without a premixing step with LAS. The order of addition to the crutcher is LAS paste/Silicate/Optical brightener/CMC/PEI1800 E7/Sodium Carbonate/Water; Steam/Sodium Sulphate/Sodium Tripolyphosphate ("STPP").

Sodium tripolyphosphate and other minors are admixed to the blown powder resulting in finished granular compositions A–D for which the relative proportions of the ingredients are set forth below:

| | Detergent Ingredient | | | |
|---|---|---|---|---|
| | A | B | C | D |
| LAS | 18.0 | 18.0 | 18.0 | 18.0 |
| PEI1800 E7 | — | 1.0 | 1.0 | 0.5 |
| Sodium silicate (2.0R) | 5.8 | 5.8 | 5.8 | 5.8 |
| Optical brightener* | 0.2 | 0.2 | 0.2 | 0.2 |
| CMC | 0.3 | 0.3 | 0.3 | 0.3 |
| Sodium carbonate | 10.0 | 10.0 | 10.0 | 10.0 |
| Sodium sulfate | 36.9 | 35.9 | 35.9 | 36.4 |
| STPP | 22.0 | 22.0 | 22.0 | 22.0 |
| Water and minors | 6.8 | 6.8 | 6.8 | 6.8 |
| | 100.0 | 100.0 | 100.0 | 100.0 |

(*Optical brightener slurried in 0.2% C45E7 Nonionic to ensure presence in organic phase.)

Performance testing for multi-cycle whiteness maintenance is conducted using standard laundry testing techniques with test swatches of fabrics with various fiber contents. Unexpectedly, compositions C and D made by a process in accordance with the invention wherein the PEI1800 E7 is premixed with LAS in the crutcher under low pH conditions (e.g. 9) exhibit significantly improved cleaning performance compared to composition B which is made by a process wherein the PEI1800 E7 is added as the last wet ingredient in the crutcher mix cycle. Also, compositions C and D unexpectedly exhibit significantly improved cleaning performance as compared to composition A, or to composition A to which 0.5% or 1.0% of PEI1800 E7 is added directly into the wash liquor.

Having thus described the invention in detail, it will be clear to those skilled in the art that various changes may be made without departing from the scope of the invention and the invention is not to be considered limited to what is described in the specification.

What is claimed is:

1. A process for producing a spray-dried granular detergent composition characterized by the steps of:

(a) premixing a detersive surfactant paste and a water-soluble or dispersible, modified polyamine in a mixer to form a premix, said modified polyamine having a polyamine backbone prior to modification via quaternization, substitution or oxidation corresponding to the formula:

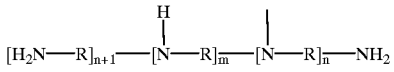

and wherein the modified polyamine has the formula $V_{(n+1)}W_mY_nZ$ or a polyamine backbone prior to modification via quaternization, substitution or oxidation corresponding to the formula:

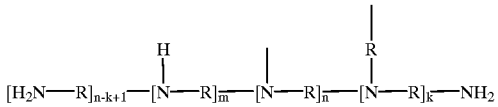

and wherein the modified polyamine has the formula $V_{(n-k+1)}W_mY_nY'_kZ$, wherein k is less than or equal to n, said polyamine backbone prior to modification has a molecular weight greater than 200 daltons, wherein i) V units are terminal units having the formula:

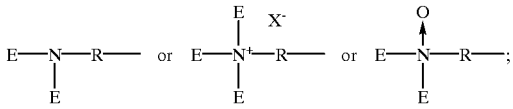

ii) W units are backbone units having the formula:

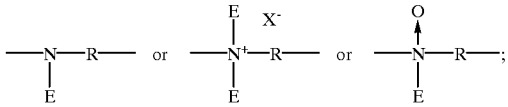

iii) Y units are branching units having the formula:

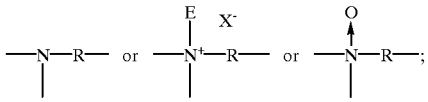

iv) Y' units are branching units having the formula:

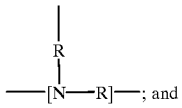

v) Z units are terminal units having the formula:

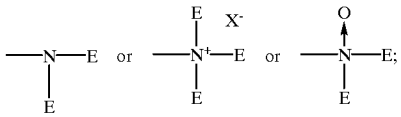

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, $—(R^1O),R^1—$, $—(R^1O)_xR^5(OR^1)_x—$, $—(CH_2CH(OR^2)CH_2O)_z(R^1O)_yR^1(OCH_2CH(OR^2)CH_2)_w—$, $—C(O)(R^4)_rC(O)—$, $—CH_2CH(OR^2)CH_2—$, and mixtures thereof; wherein $R^1$ is $C_2$–$C_6$ alkylene and mixtures thereof; $R^2$ is hydrogen, $—(R^1O)_xB$, and mixtures thereof; $R^4$ is $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is $C_1$–$C_{12}$ alkylene, $C_3$–$C_{12}$ hydroxyalkylene, $C_4$–$C_{12}$ dihydroxy-alkylene, $C_8$–$C_{12}$ dialkylarylene, $—C(O)—$, $—C(O)NHR^6NHC(O)—$, $—R^1(OR^1)—$, $—C(O)(R^4)_rC(O)—$, $—CH_2CH(OH)CH_2—$, $—CH_2CH(OH)CH_2O(R^1O)_yR^1OCH_2CH(OH)CH_2—$, and mixtures thereof; $R^6$ is $C_2$–$C_{12}$ alkylene or $C_6$–$C_{12}$ arylene; E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, $—(CH_2)_pCO_2M$, $—(CH_2)_qSO_3M$, $—CH(CH_2CO_2M)CO_2M$, $—(CH_2)_pPO_3M$, $—(R^1O)_xB$, $—C(O)R^3$, and mixtures thereof; $R^3$ is $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; B is hydrogen, $C_1$–$C_6$ alkyl, $—(CH_2)_qSO_3M$, $—(CH_2)_pCO_2M$, $—(CH_2)_q(CHSO_3M)CH_2SO_3M$, $—(CH_2)_q—(CHSO_2M)CH_2SO_3M$, $(CH_2)_pPO_3M$, —$PO_3M$, and mixtures thereof; M is hydrogen or a water soluble cation in sufficient amount to satisfy charge balance; X is a water soluble anion; m has the value from 4 to 400; n has the value from 0 to 200; p has the value from 1 to 6, q has the value from 0 to 6; r has the value of 0 or 1; w has the value 0 or l; x has the value from 1 to 100; y has the value from 0 to 100; z has the value 0 or 1; and (b) mixing, subsequent to said premixing step, a detergent builder and water into said mixer to form a slurry; and (c) spray drying said slurry so as to form said spray-dried granular detergent composition.

2. The process of claim 1 wherein the pH of said premix is in a range from 8 to 10.

3. The process of claim 1 wherein said modified polyamine is present in an amount of from 0.01% to about 10% by weight of said granular detergent composition.

4. The process of claim 1 wherein said premixing step is performed in an in-line static mixer.

5. The process of claim 1 wherein said mixing step includes the step of mixing adjunct detergent ingredients selected from the group consisting of silicates, optical brighteners, antiredeposition agents, fillers and mixtures thereof.

6. The process of claim 1 wherein said detergent builder is selected from the group consisting of aluminosilicates, carbonates, phosphates and mixtures thereof.

7. The process of claim 1 further comprising the step of adding steam to said mixer prior to said spray drying step.

8. The process of claim 1 wherein said detersive surfactant paste comprises from about 20% to about 60%, by weight of said detersive surfactant paste, of sodium linear alkylbenzene sulfonate surfactant and the balance water.

9. The process of claim 1 wherein R is $C_2$–$C_{12}$ alkylene.

10. A process for producing a spray-dried granular detergent composition comprising the steps of:

(a) premixing an acid precursor of a detersive surfactant and a water-soluble or dispersible, modified polyamine in a mixer to form a premix, said modified polyamine having a polyamine backbone prior to modification via quaternization, substitution or oxidation corresponding to the formula:

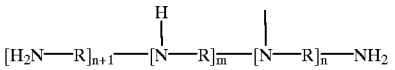

and wherein the modified polyamine has the formula $V_{(n+1)}W_mY_nZ$ or a polyamine backbone prior to modification via quaternization, substitution or oxidation corresponding to the formula:

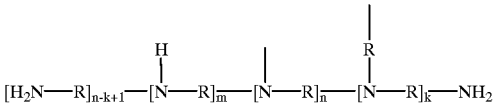

and wherein the modified polyamine has the formula $V_{(n-k+1)}W_mY_nY'_kZ$ wherein k is less than or equal to n, said polyamine backbone prior to modification has a molecular weight greater than about 200 daltons, wherein i) V units are terminal units having the formula:

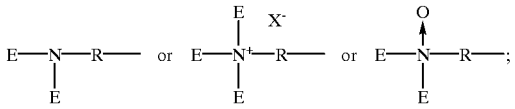

ii) W units are backbone units having the formula:

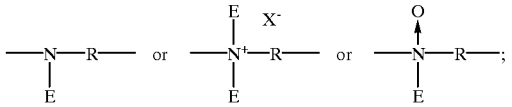

iii) Y units are branching units having the formula:

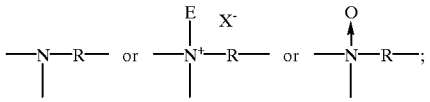

iv) Y' units are branching units having the formula:

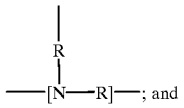

v) Z units are terminal units having the formula:

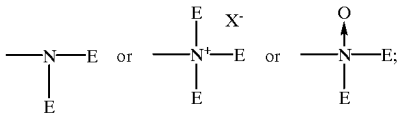

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, —$(R^1O)_xR^1$—, —$(R^1O)_xR^5(OR^1)_x$—, —$(CH_2CH(OR^2)CH_2O)_z(R^1O)_yR^1(OCH_2CH(OR^2)CH_2)_w$—, —$C(O)(R^4)_rC(O)$—, —$CH_2CH(OR^2)CH_2$—, and mixtures thereof; wherein $R^1$ is $C_2$–$C_6$ alkylene and mixtures thereof; $R^2$ is hydrogen, —$(R^1O)_xB$, and mixtures thereof; $R^4$ is $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is $C_1$–$C_{12}$ alkylene, $C_3$–$C_{12}$ hydroxyalkylene, $C_4$–$C_{12}$ dihydroxy-alkylene, $C_8$–$C_{12}$ dialkylarylene, —C(O)—, —$C(O)NHR^6NHC(O)$—, —$R^1(OR^1)$—, —$C(O)(R^4)_rC(O)$—, —$CH_2CH(OH)CH_2$—, —$CH_2CH(OH)CH_2O(R^1O)_yR^1OCH_2CH(OH)CH_2$—, and mixtures thereof; $R^6$ is $C_2$–$C_{12}$ alkylene or $C_6$–$C_{12}$ arylene; E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_xB$, —$C(O)R^3$, and mixtures thereof; $R^3$ is $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; B is hydrogen, $C_1$–$C_6$ alkyl, —$(CH_2)_qSO_3M$, —$(CH_2)_pCO_2M$, —$(CH_2)_q(CHSO_3M)CH_2SO_3M$, —$(CH_2)_q$—$(CHSO_2M)CH_2SO_3M$, —$(CH_2)_pPO_3M$, —$PO_3M$, and mixtures thereof; M is hydrogen or a water soluble cation in sufficient amount to satisfy charge balance; X is a water soluble anion; m has the value from 4 to about 400; n has the value from 0 to about 200; p has the value from 1 to 6, q has the value from 0 to 6; r has the value of 0 or 1; w has the value 0 or 1; x has the value from 1 to 100; y has the value from 0 to 100; z has the value 0 or 1;

(b) neutralizing said premix with a neutralizing agent which is added to said mixer;

(c) mixing a detergent builder and water into said mixer to form a slurry; and (d) spray drying said slurry so as to form said spray-dried granular detergent composition.

11. The process of claim 10 wherein the pH of said premix is in a range from about 1 to about 3.

12. The process of claim 10 wherein said modified polyamine is present in an amount of from 0.01% to about 10% by weight of said granular detergent composition.

13. The process of claim 10 wherein said premixing step is performed in a temperature range of from about 40° C. to about 70° C.

14. The process of claim 10 wherein said mixing step includes the step of mixing adjunct detergent ingredients selected from the group consisting of silicates, optical brighteners, antiredeposition agents, fillers and mixtures thereof.

15. The process of claim 10 wherein said neutralizing agent is selected from the group consisting of sodium hydroxide, sodium carbonate, sodium silicate and mixtures thereof.

16. The process of claim 10 further comprising the step of adding steam to said mixer prior to said spray drying step.

17. The process of claim 10 wherein said detersive surfactant comprises linear alkylbenzene sulfonate surfactant.

18. The process of claim 10 wherein R is $C_2$–$C_{12}$ alkylene.

* * * * *